US007384107B2

(12) United States Patent
Humberto

(10) Patent No.: US 7,384,107 B2
(45) Date of Patent: Jun. 10, 2008

(54) MODULAR SYSTEM OF CLOSET INSIDE PART BASED ON ADJUSTABLE UNITS EASILY ASSEMBLED AND PACKED BY THE USER

(76) Inventor: Orozoo Gavaldon Humberto, Plaza del Aguila No. 12, Col. A. Ortiz Tirado, C.P.09020, Mexico City (MX)

( * ) Notice: Subject to any disclaimer, the term of this patent is extended or adjusted under 35 U.S.C. 154(b) by 284 days.

(21) Appl. No.: 10/812,441

(22) Filed: Mar. 30, 2004

(65) Prior Publication Data

US 2004/0263030 A1 Dec. 30, 2004

(30) Foreign Application Priority Data

Jun. 6, 2003 (MX) ..... PA/A/2003/004388

(51) Int. Cl.
*A47B 61/00* (2006.01)

(52) U.S. Cl. ..... 312/245; 108/193; 211/90.01

(58) Field of Classification Search ..... 211/90.04, 211/149, 186, 189, 105.1, 204, 206; 312/257.1, 312/263, 245, 351, 203, 107, 108, 7.2; 108/29, 108/106, 107, 109, 110, 181, 193, 147.11, 108/158, 147.16, 149, 158.11
See application file for complete search history.

(56) References Cited

U.S. PATENT DOCUMENTS 2,115,130 A * 4/1938 Shults et al. ..... 108/27
3,538,842 A * 11/1970 Labbato ..... 108/29
3,565,020 A * 2/1971 Schier et al. ..... 108/152
3,846,002 A * 11/1974 Floetotto ..... 312/107
3,848,942 A * 11/1974 Fanini ..... 312/265.5
4,206,955 A * 6/1980 Cooper ..... 312/107
4,324,076 A * 4/1982 Honickman ..... 52/27
4,596,195 A * 6/1986 Wenger ..... 108/31
4,995,323 A * 2/1991 Kellems et al. ..... 108/157.13
5,582,306 A * 12/1996 Balter et al. ..... 211/187
6,082,560 A * 7/2000 Timm ..... 211/90.01
6,896,341 B2 * 5/2005 Cattoire ..... 312/205
6,988,628 B2 * 1/2006 Krieger et al. ..... 211/86.01
2004/0256337 A1 * 12/2004 Humberto ..... 211/87.01

FOREIGN PATENT DOCUMENTS

EP 0080306 * 11/1982

* cited by examiner

*Primary Examiner*—Janet M. Wilkens
(74) *Attorney, Agent, or Firm*—Carmen Pili Ekstrom

(57) ABSTRACT

A closet inside part modular system made of agglomerated material units, preferably 12 mm. thick and mass manufactured, of adjustable sizes, with combinable systems to increase their amplitude, standardized according to modern standards of popular or residential housing, characterized because it is easy to assembly, shows a high resistance to impacts and item overload, making optimum use of the available wardrobe space, with or without lateral edge reinforcement.

15 Claims, 15 Drawing Sheets

FIG. 8
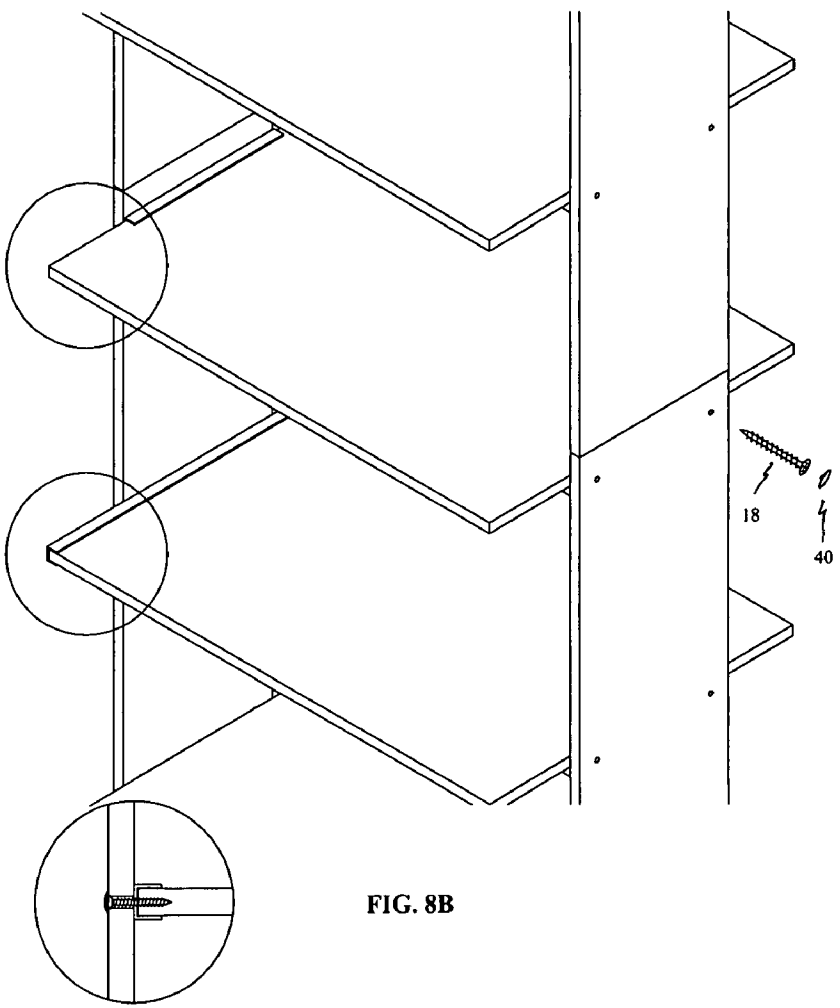
FIG. 8B
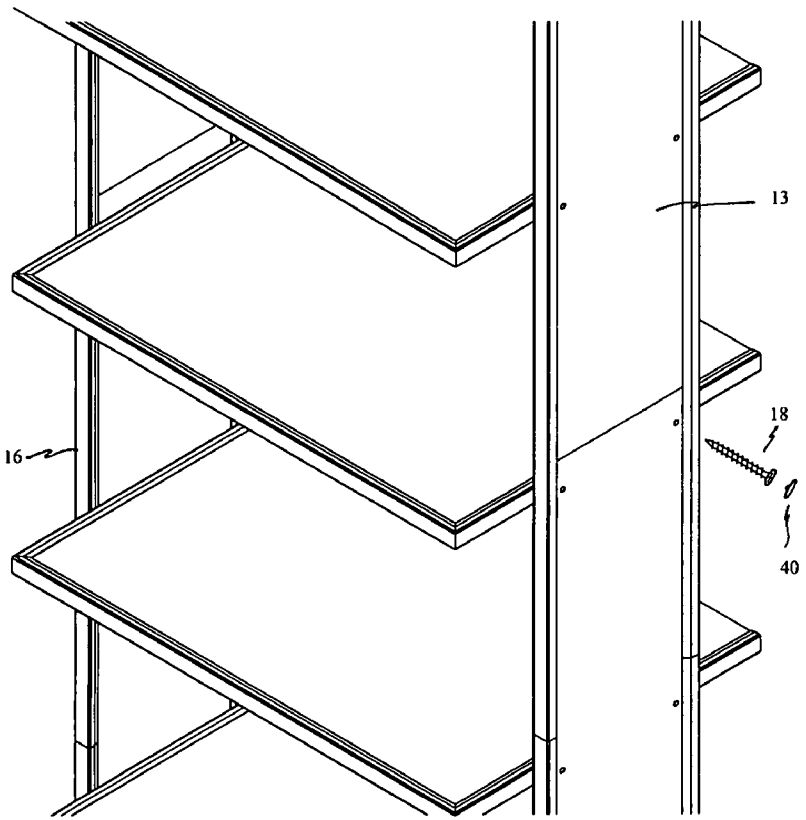
FIG. 8A

Figure 11:
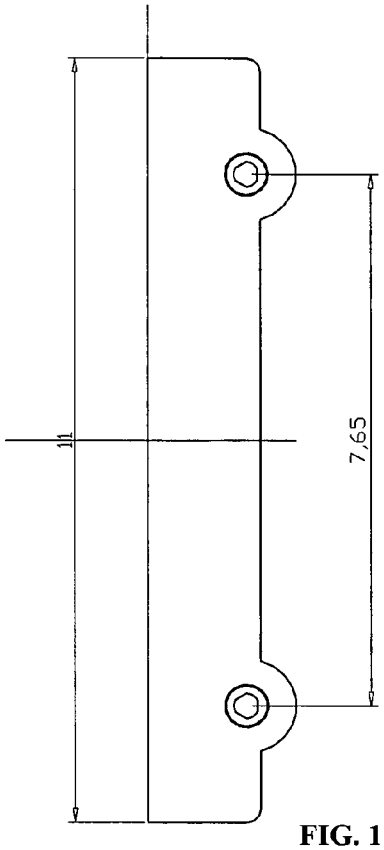
Figure 11B:
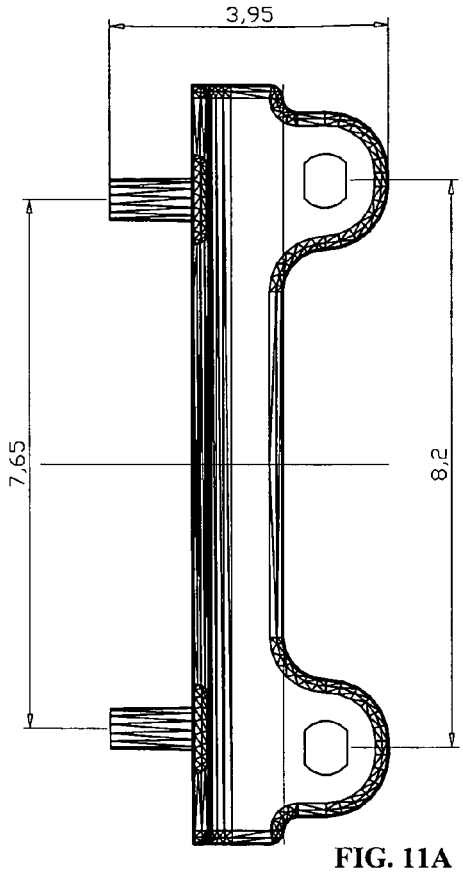
Figure 11A:
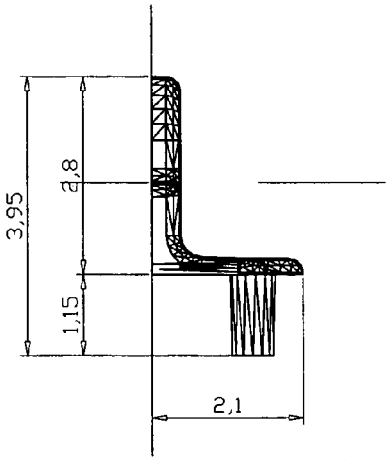
Figure 11A:
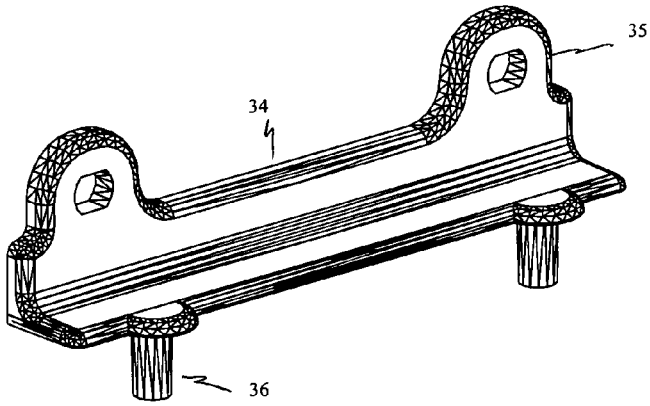

FIG. 10
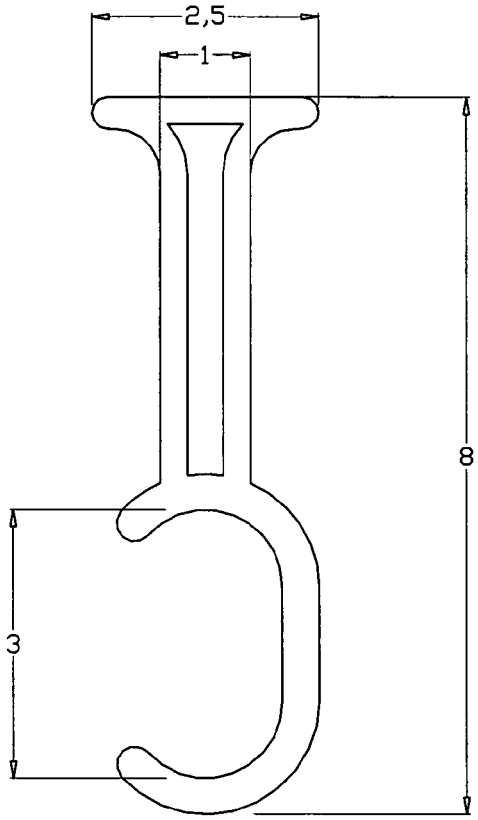
a FIG. 10A
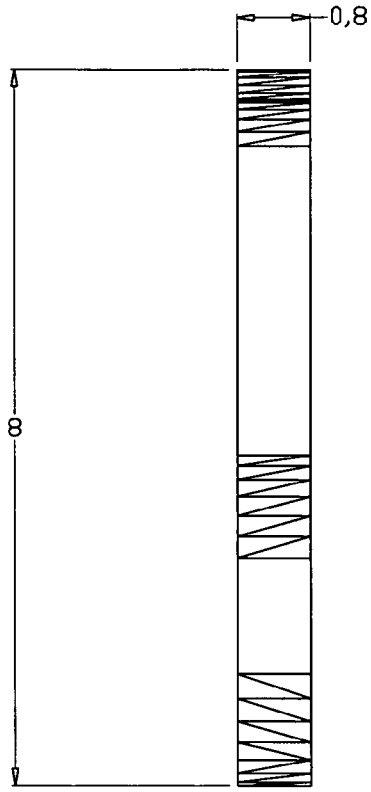
b FIG. 10B
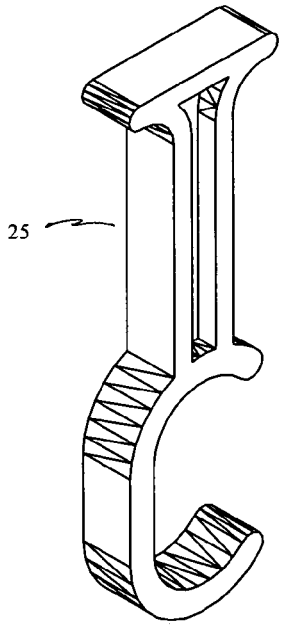
FIG. 10C b a c FIG. 11C d FIG. 11D

FIG. 12
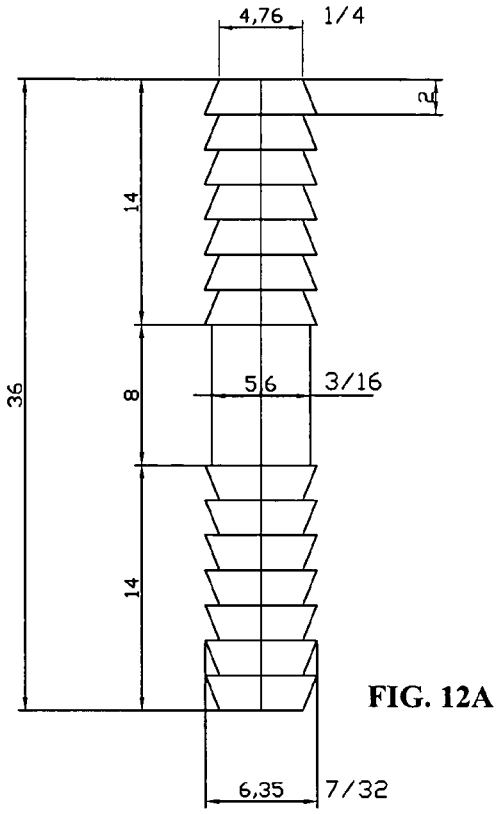
a
FIG. 12A
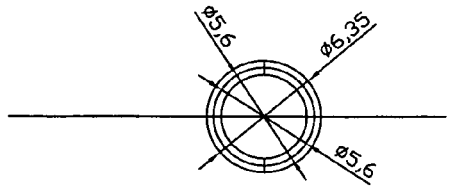
b
FIG. 12B
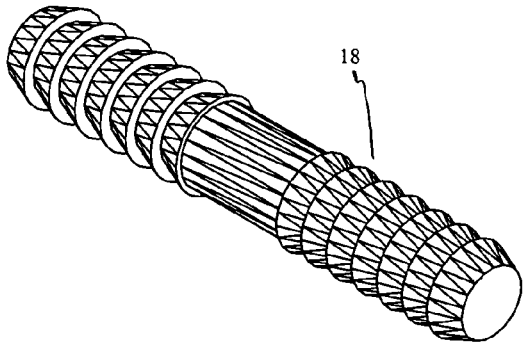
FIG. 12C

FIG. 13
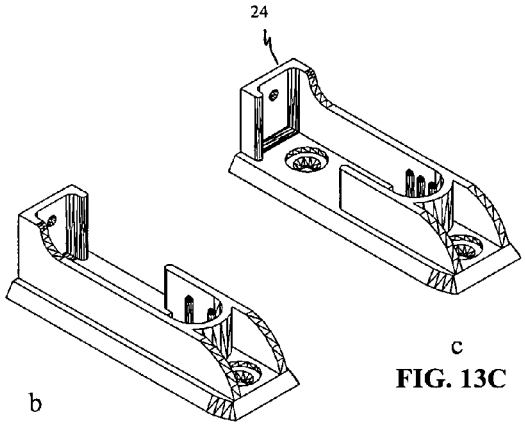
b
FIG. 13B
c
FIG. 13C
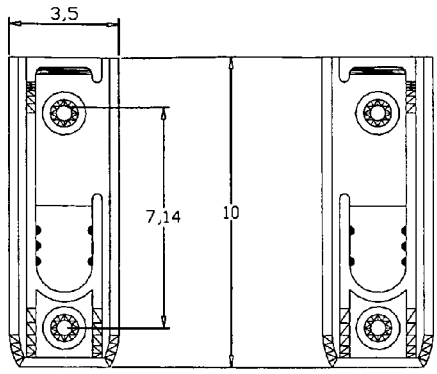
d
FIG. 13D
e
FIG. 13E
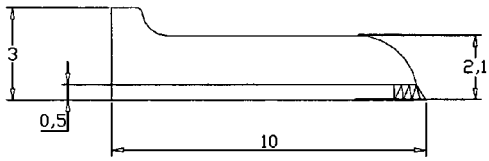
a FIG. 13A a FIG. 14A b FIG. 14B c FIG. 14C FIG. 15
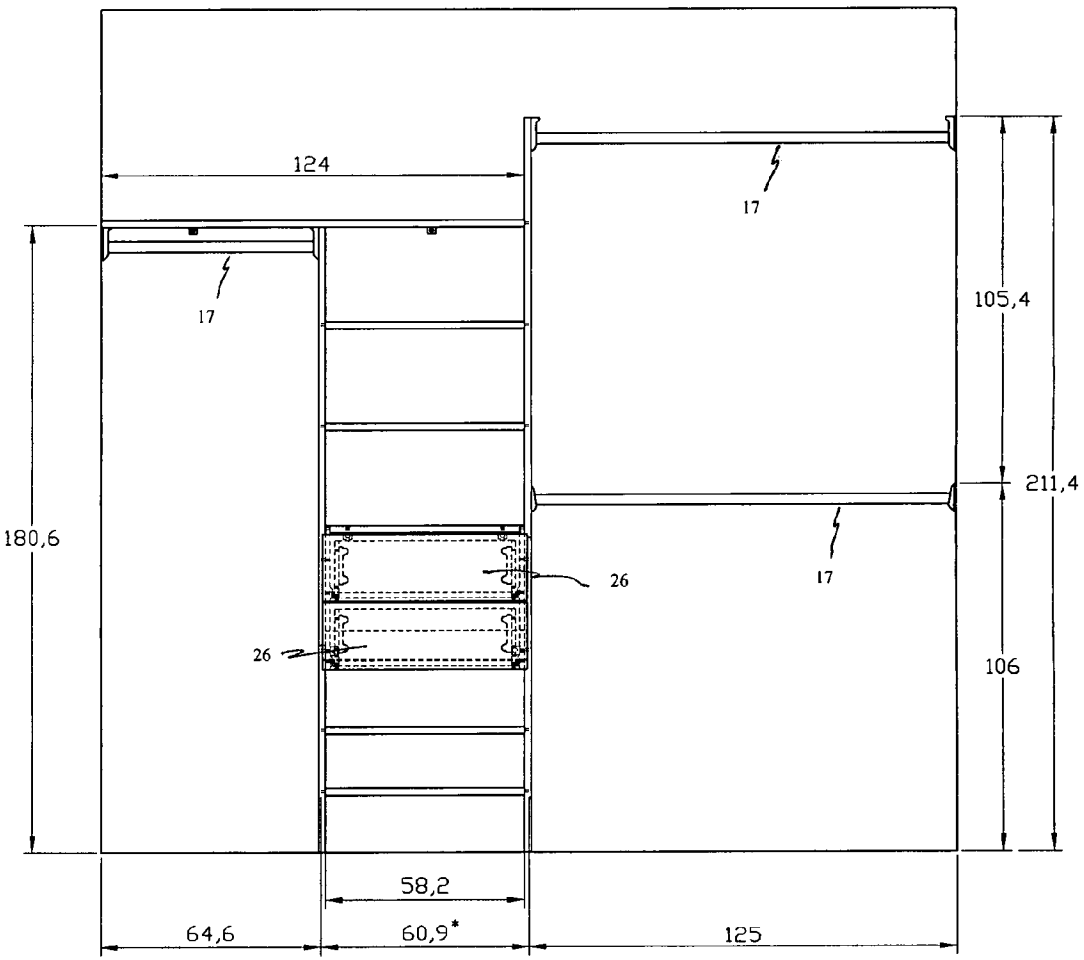
FIG. 15B
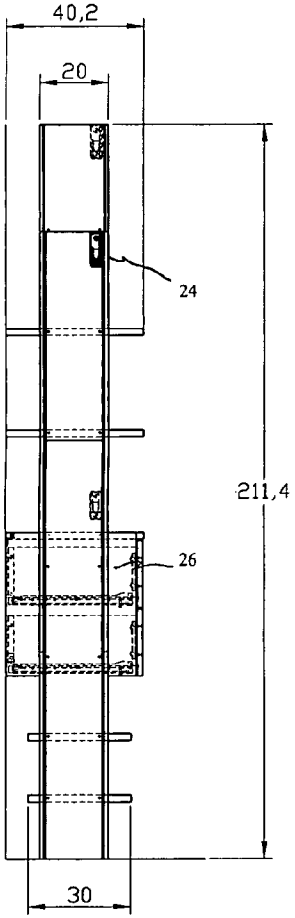
FIG. 15A
10

MODULAR SYSTEM OF CLOSET INSIDE PART BASED ON ADJUSTABLE UNITS EASILY ASSEMBLED AND PACKED BY THE USER

BACKGROUND OF THE INVENTION

1. Field of the Invention

Modular system of closet inside part mass manufactured in units of agglomerated material, of adjustable and standardized sizes according to the needs of modern popular or residential buildings, characterized because it is easy to assemble, highly resistant to impacts or items overload, and using optimally wardrobe spaces, with or without lateral edge reinforcement.

2. Description of the Previous Art

Several closet construction designs are known, such as the assembling of pieces or modules generally of solid wood, fine wood or pine wood. For example, British Patent 640, 518, describes a dismountable closet based on a module with lateral and back walls formed as one single unit. Japanese Patent 5141080 describes the building structure of a closet based on a smaller member of parts through the use of grooved posts for the assembly of the lateral walls.

U.S. Pat. No. 5,718,490 describes a portable dismountable closet for travels, characterized because it has a textile cover on a supporting tubular structure for assembly purposes.

U.S. Pat. No. 4,209,099 describes a support module for closet to increase the usable space in the closet, based on bars placed in horizontal or vertical positions and assembled on collapsible cylindrical pipes through connecting elements with intersection joints.

Japanese Patent 5098791 describes the formation of a closet through the assembly of wooden frame shaped panels with heat insulation structure with "U" shaped sections and fixed onto posts, forming units.

U.S. Pat. No. 6,079,803 describes a system of closet organization and a method for its installation, characterized because it features the assembly of a console unit, the unit having tubular plastic posts to include additional racks.

U.S. Pat. No. 6,113,208 describes a self-assembly closet, that uses clip elements to fasten the shelves onto the lateral parts of the closet through a tongued and grooved assembly.

The above-mentioned inventions are generally characterized because they propose adjustable closets that can be assembled and dismounted. The invention relates to pieces of furniture such as closets, book shelves, etc. made of agglomerated-wood based materials that, through various manufacturing techniques, are made as resistant and durable as the pieces of furniture made of solid material. Moreover, said pieces of furniture can be assembled, dismounted and adjusted to the space available according to popular or residential building standards.

DESCRIPTION OF THE INVENTION

Figure 1:
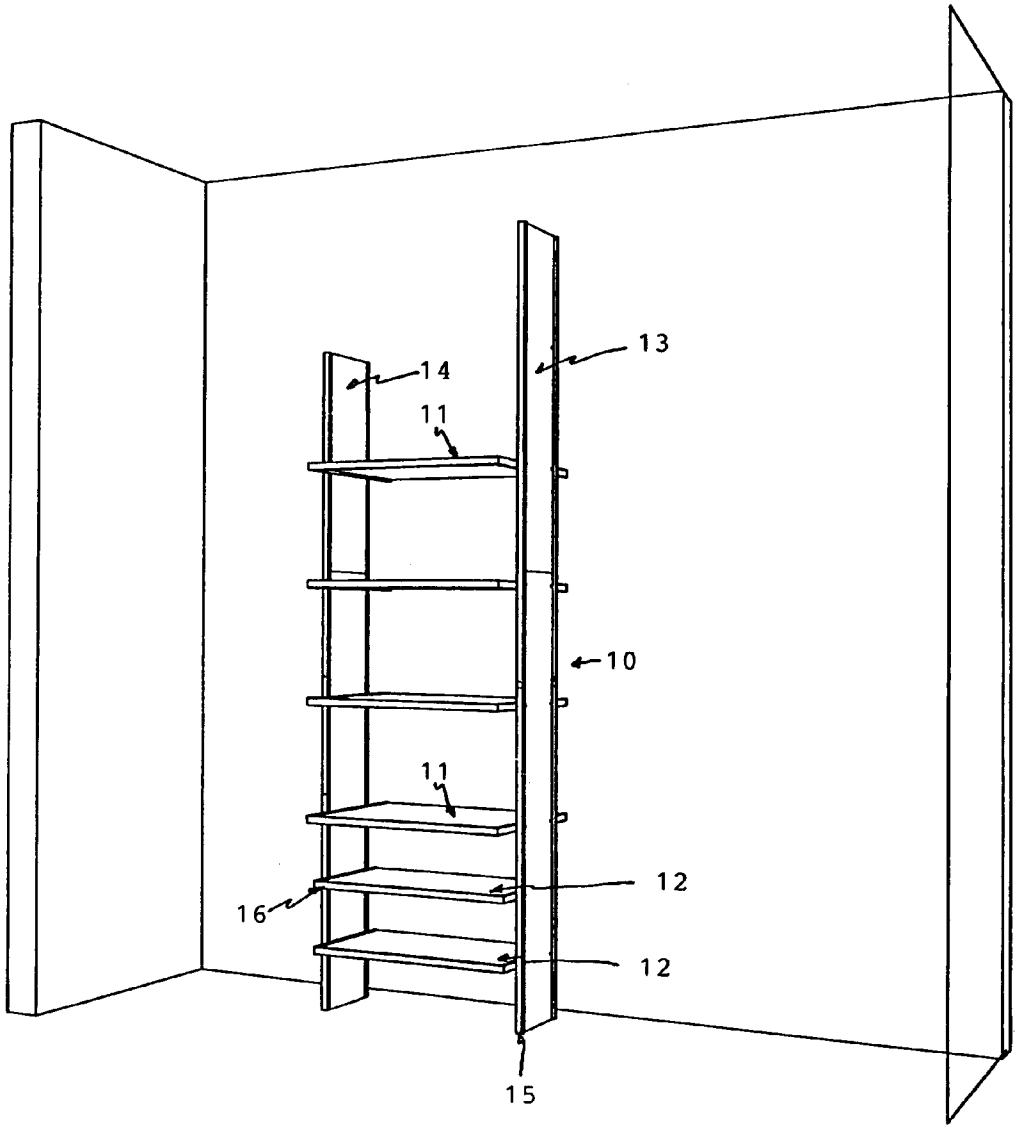

Hereinafter the invention is described with regard to FIGS. 1 to 15 wherein:

FIG. 1 corresponds to a perspective view of the main module of the closet inside part.

Figure 2:
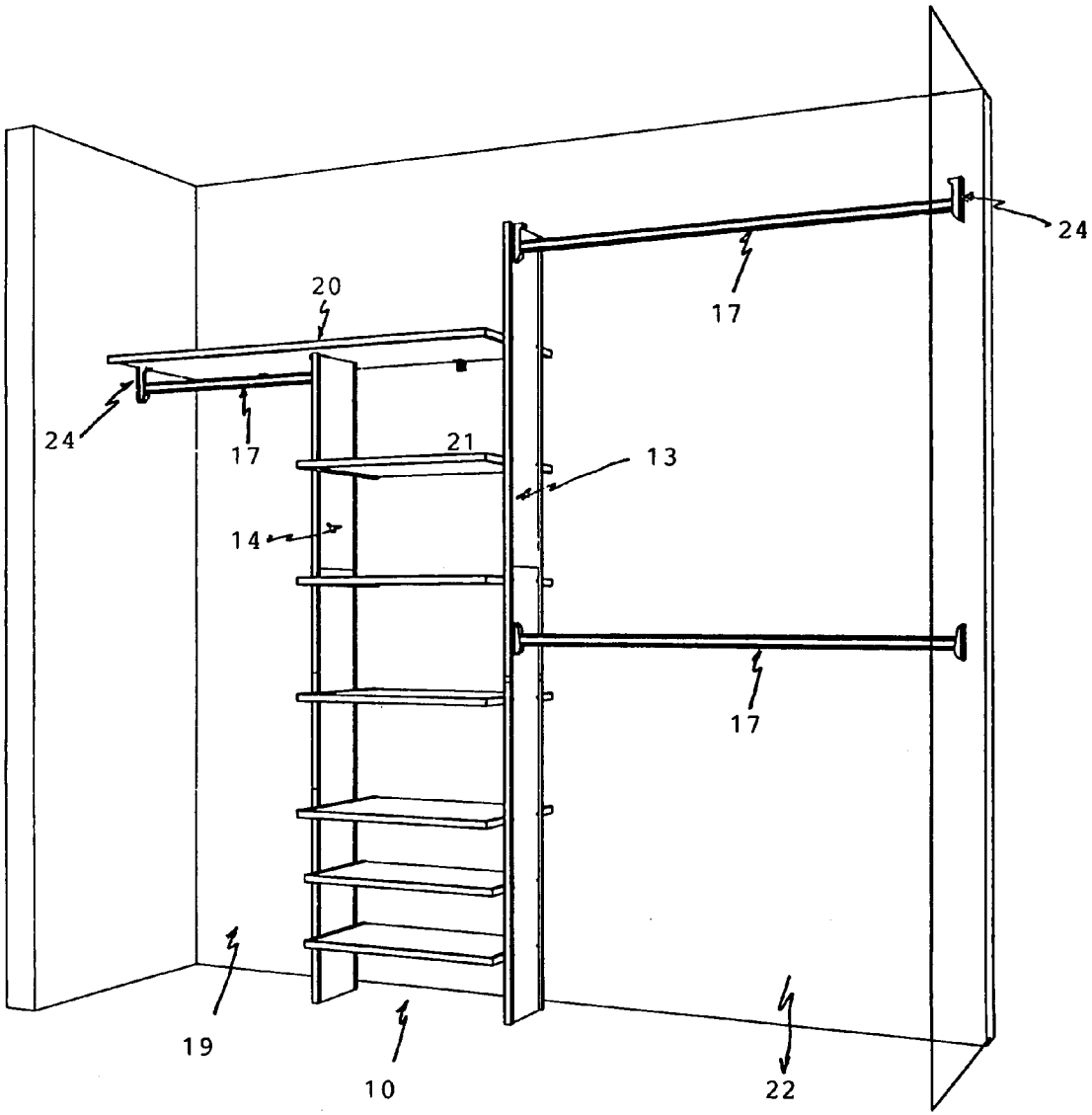

FIG. 2 corresponds to a perspective view of a first mode of adjustable assembly of FIG. 1.

Figure 3:
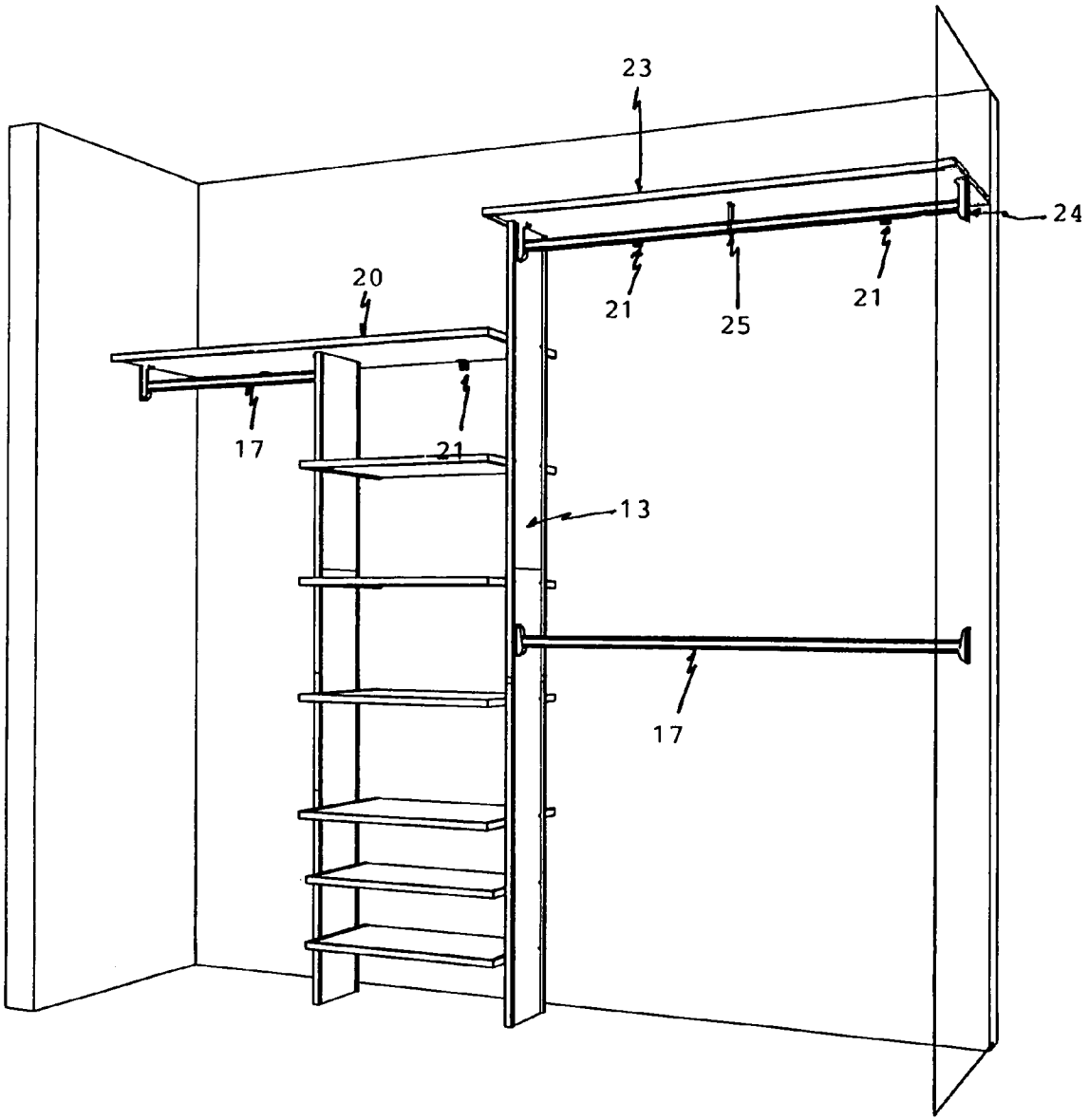

FIG. 3 corresponds to a perspective view of a further mode of adjustable assembly of FIG. 2.

Figure 4:
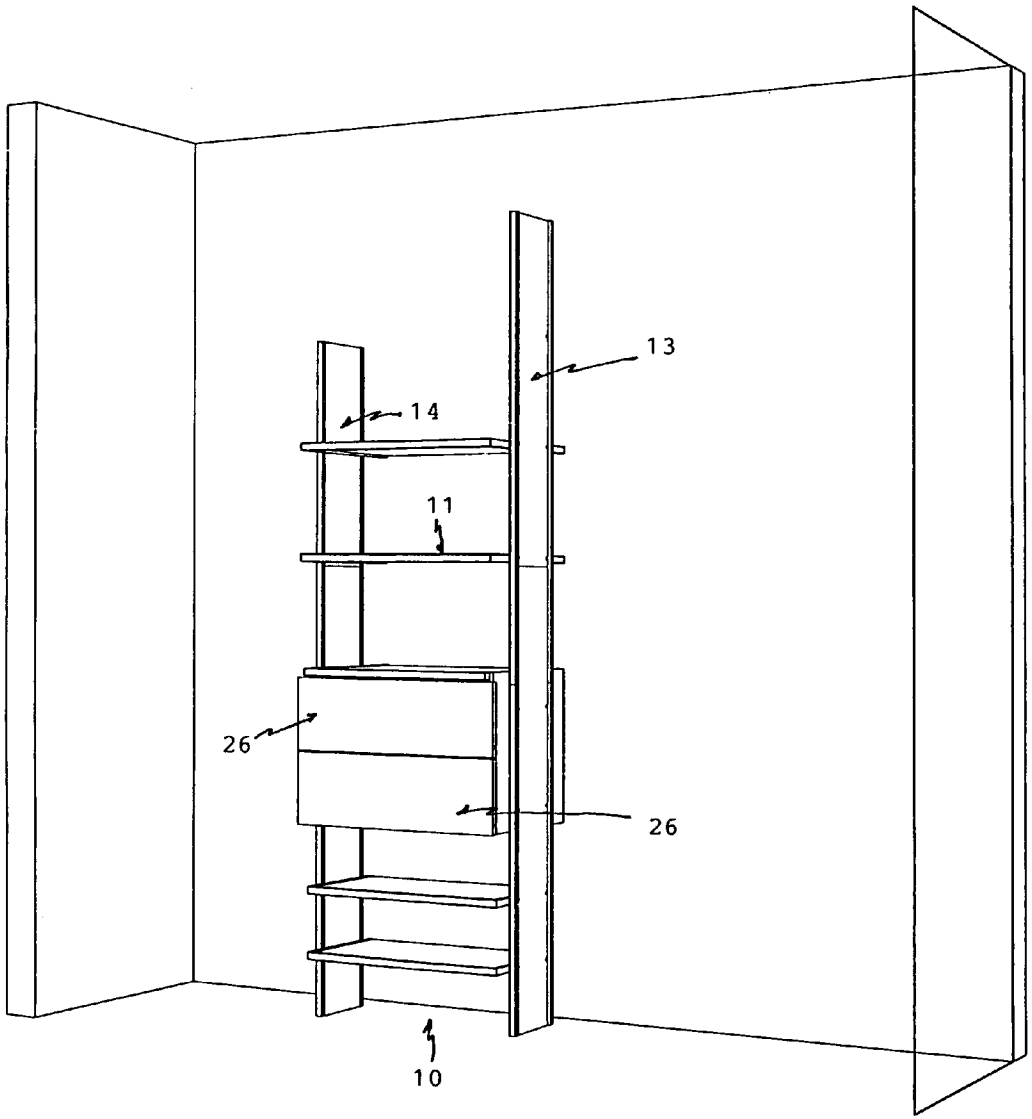

FIG. 4 corresponds to a perspective view of another further mode of adjustable assembly of FIG. 1.

Figure 5:
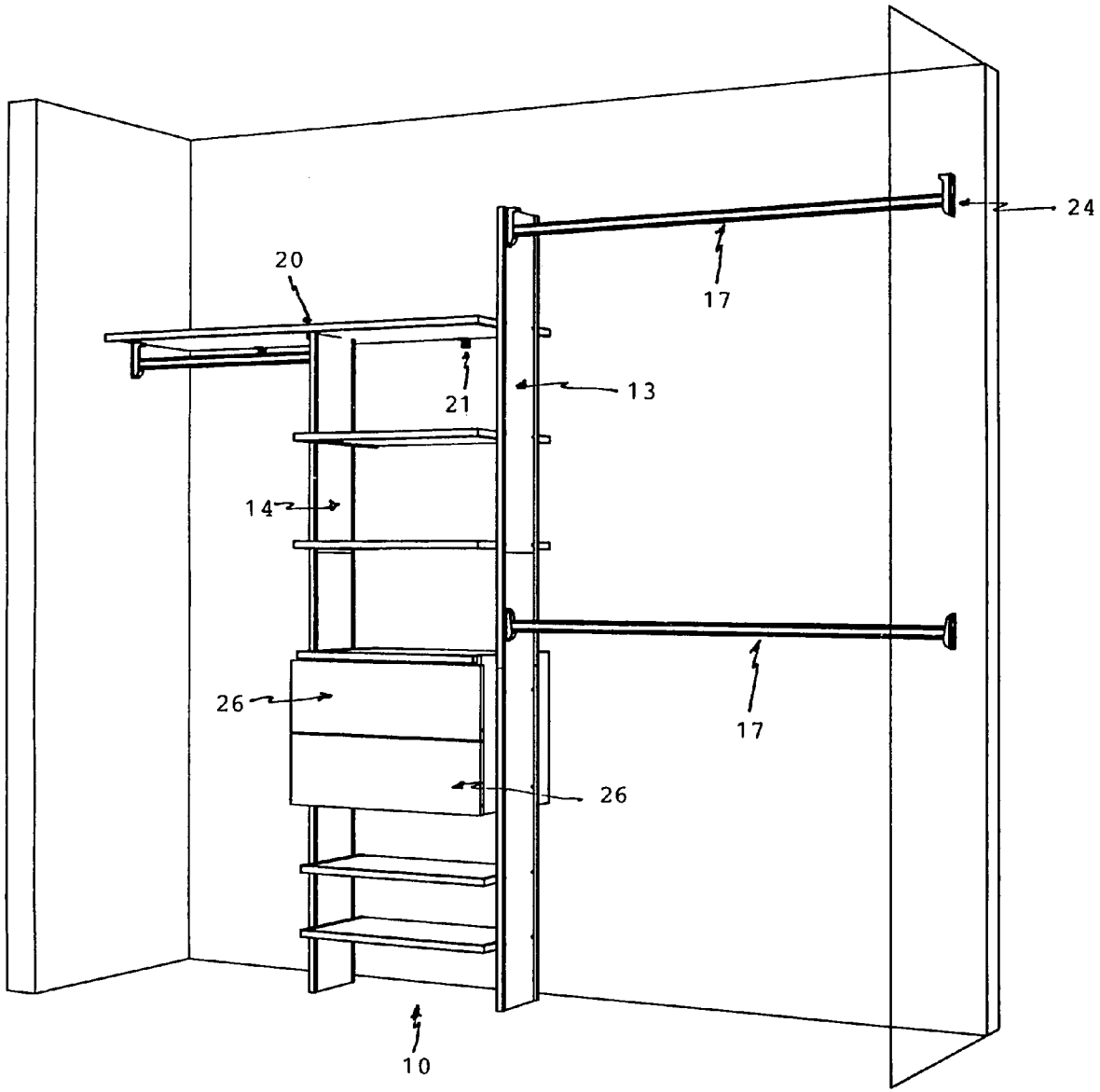

FIG. 5 corresponds to a perspective view of a further mode of assembly of FIG. 4.

Figure 6:
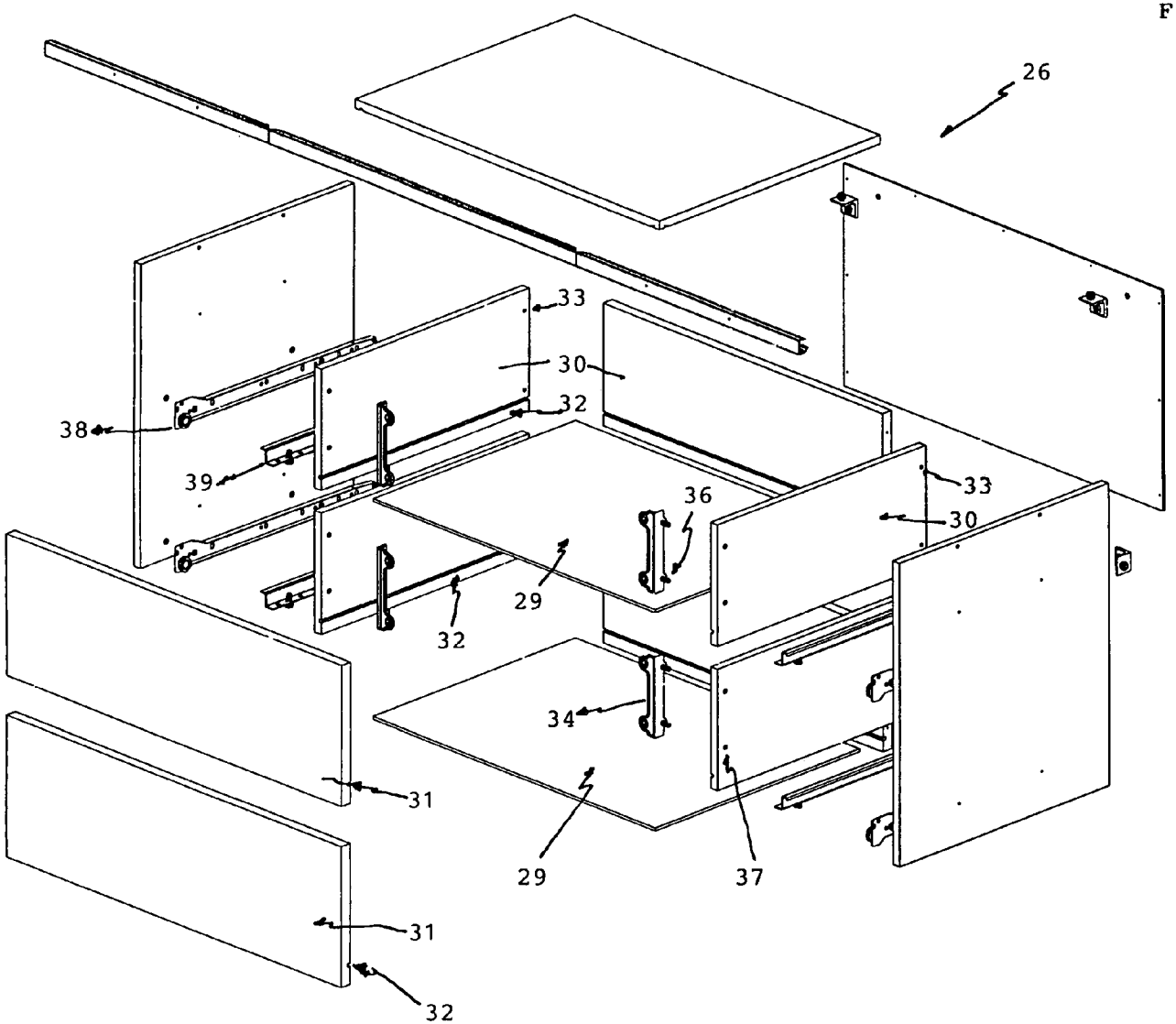

FIG. 6 corresponds to an exploded view of the assembly of a chest of drawers of FIG. 4.

FIGS. 7A, 7B and 7C corresponds to an exploded perspective view of a shelf of FIG. 1.

FIG. 8A corresponds to a perspective view of a shelf section of FIG. 1, with structural profile, and FIG. 8B with veneer strip or lateral reinforcement profile.

FIGS. 9A, 9B, 9C and 9D corresponds to a perspective view of the lateral screen of FIG. 1.

FIGS. 10A, 10B and 10C corresponds to a perspective view of the fastening and support element, from the front (a) or side (b) of FIG. 3.

FIGS. 11A, 11B, 11C and 11D corresponds to a perspective view of the fastening and assembly pin of FIG. 6 ((front view (a), (b); side view (c) and perspective view (d)).

FIGS. 12A, 12B and 12C corresponds to a perspective view of the fastening element for screen assembly, front view (a), and cross section (b).

FIGS. 13A, 13B, 13C and 13D corresponds to a perspective view of the fastening device of the hanging pipe, side view (a), (b), (c) and front view (d), (e).

FIGS. 14A, 14B, 14C and 14D corresponds to a perspective view of the fastening element of the device, superior view (a), side view (b) and (c).

FIGS. 15A and 15B corresponds to a front view of FIG. 5, measured in cm.

The closet inside part is an easily assembled packed modular system adjustable to the space available. It is offered in standard sizes and can be combined for larger spaces from a minimum to a maximum size according to the needs of the user. Said closet inside part consists of a series of mountable modules based on a section provided to hang long clothes, a shelf tower and double hanging section for short clothes. The sections are separated by vertical screens that are longitudinally assembled because said screens are not made of single pieces. The vertical screens are packed in at least two sections, each one fitting inside the box of the closet inside part. The main module is a tower with several shelves 10, FIG. 1, said tower is assembled first through screwing and is fastened onto the wall of the available space.

The shelf tower 10 is a vertical frame with shelves 11 of depth adequate to place folded clothes or shoes 12. Its sizes take full advantage of the agglomerated raw material sheets from which they are obtained. In the shelf tower, it is also possible to place drawers 26 FIG. 4. In the same shelf tower, it is possible to assemble shelves purchased as separate accessories.

The frame consists also of two screens 13 and 14 vertically placed to be fastened to the shelves, one of said screens 13 is higher to create the desired organizer.

The vertical screen 13 is placed very near the mid part of the full width design of the closet inside part and in this way the user can cover afterwards said closet inside part using a set of two equal sliding doors. Besides, if the user wishes to, he can keep said piece in a different position adjusting the product to the width of the existing enclosure through the cutting of shelves and pipes at both sides of the closet inside part. Moreover, said user can choose to cut one side more than the other to keep a larger quantity of short clothes than long clothes or vice versa.

The vertical screens 13, 14 measures no more than half the depth of the deepest shelves. Moreover, the vertical screens are placed far away from the back wall, and in this way it is possible to place the clothes on the shelves through the sides and at the same time it is possible to see the clothes kept up to the contact with the back wall, facilitating the cleaning. The clothes are ventilated in the lowest part, preventing confinement that favors insect nesting, fungus growth or moisture accumulation.

The placement of the vertical screens separated from the back wall makes it easy to obtain the adequate seating of the weight of the closet and the load placed on the shelves and the load received by the hanger pipes sustaining clothes, preventing deformation of the structure of the closet inside part.

The shelves 11 of the tower or frame 10 are panels made of agglomerated material, preferably 40 cm deep and 61 cm long, approximately.

The edges 15 of the screens and the edges 16 of the shelves, FIG. 10 can be reinforced through PVC profiles such as is described in Mexican Patent 202201, owned by the applicant, or as is indicated in Mexican Patent Application No. PA/a/2001/011576. In this way, it is possible to obtain a high quality finishing or through the application of a veneer strip it is possible to obtain an economical closet. Said closet is highly resistant to lateral mechanical stresses through its assembly system. Moreover, it can be reinforced on its left and right side edges, totally or partially with regard to the width of the screen to increase its strength in the case of thin panels through "U"-shaped profiles made of plastic or other material.

The shelf tower is characterized because it is made by two screens preferably, 20 cm wide. Each screen is integrated by two assembly sections reinforced with an economically extruded profile through screwing or tongued and grooved assembly, pressure fit plastic or metal. Each screen presents a minimum thickness that is equal to the thickness of the shelves, preferably from 12 to 19 mm being in this way possible to carry a relatively light package. Because it has vertical screens on only half the depth of the deepest shelves, the weight of the screens is divided by half.

Because they are half the depth of the deepest shelves 11, two pieces of vertical screens fit in only one layer of material within the box instead of needing two layers and in this way the package is smaller.

Because previously laminated agglomerated material is used, a high quality and durable finish can be obtained which is washable.

The hanger pipes 17 FIGS. 2 and 3, are made of steel and of oval cross section to improve their load capacity and reduce the weight of the package and are PVC covered through extrusion so that they can be used in all climates. Instead of this, it is possible to use other types of hanging elements, of one piece or collapsible. Caps are supplied 40, FIGS. 8 and 9, for the heads of the placement and assembly screws and pegs or anchors are supplied for concrete, brick, block, plaster and wood walls, indistinctively.

In FIG. 2, the first combination of mass manufactured modules can be seen. Said combination includes: shelf tower 10, a left side long clothes hanging module 19, through the incorporation of a panel 20 placed in the upper end of the shorter screen 14 of the tower 10 and fastened to it through an element 24, FIG. 13 C and fastened to the larger screen 13 through screws 18 FIG. 9 C and through plastic fastening elements 21, FIG. 14 D onto the enclosure wall. It also includes a right side hanging module 22 with two hanging sections 17, FIG. 3 based on a larger panel 23 fastened by two plastic fastening elements 21, onto the wall and supported on the larger screen 13, the hanging pipe 17 is pressure assembled on a couple of plastic fastening elements 24, FIGS. 2 and 13 C and through screws. reinforced in its intermediate part against excess load through a fork element 25, FIGS. 3 and 10 which is assembled in the hanging pipe 17 that opposes compression stresses because the excess lo load is absorbed by the steel pipe 17. The fork 25 can slide to any desired position because it is not screwed.

Figure 7:
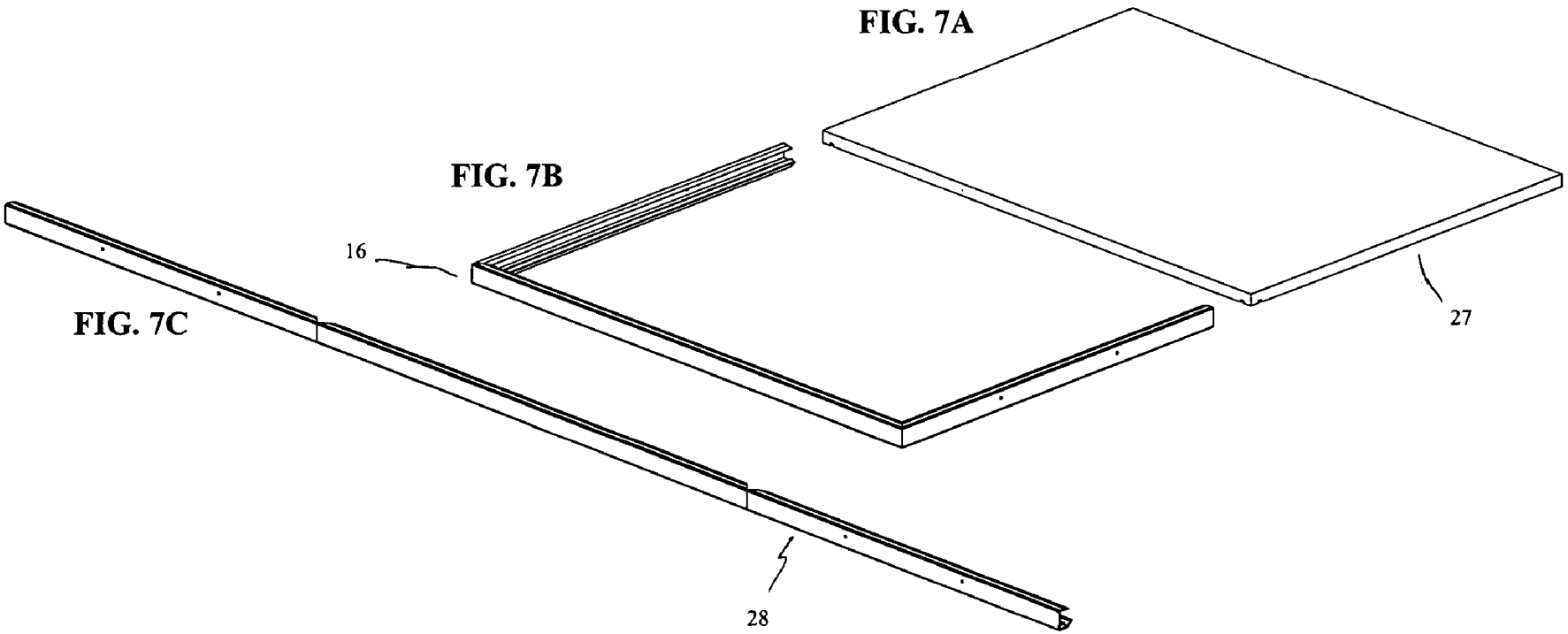
Figures 9, 9A, 9B, 9C, 9D:
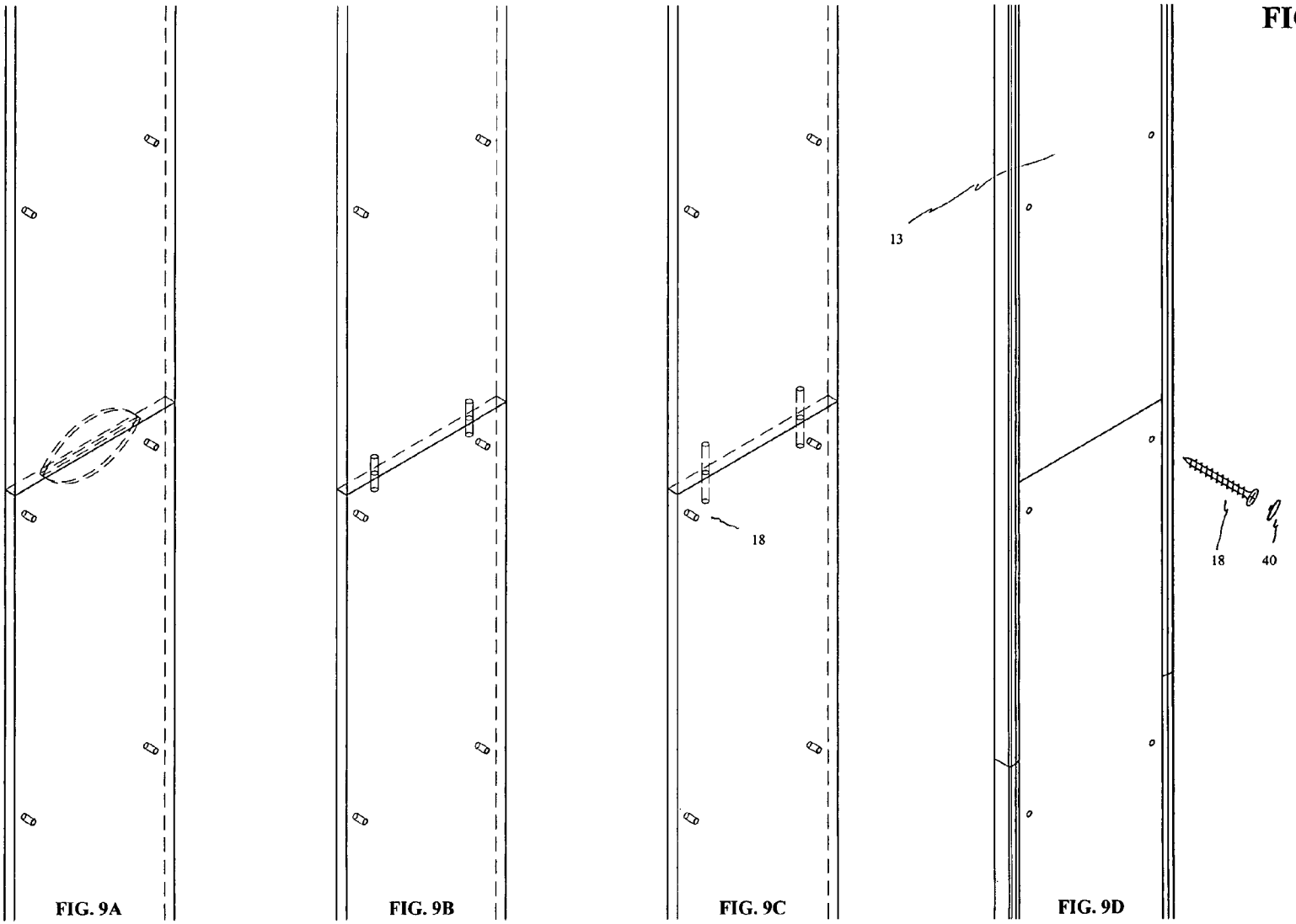

An additional combination FIGS. 4, 5 and 6 to previous modular combination relates to inclusion of chests by drawers 26 that offer a comfortable closet inside part for residential or popular housing depending on the finish of the edges 27, FIG. 7 A of the organizing system, i.e the extruding profiles 28 FIG. 7C or adhered veneer strips.

A second combination FIGS. 2 and 3 of the shelf tower is different from the first combination because the long clothes hanging module is larger because it has a longer upper panel 20 and about twice the shelves of the tower 10.

A variation FIG. 15 B of the second combination is the incorporation of two or more chests of drawers 26 depending on the needs or it can include a larger member of shelves and the preferred sizes are shown in said figure, in cm.

In FIG. 6, the parts making up a chest of drawers consisting of two units are shown. Said chest of drawers consist of a base 29, three side shelves 30 and a front shelf 31 each one having a recessed profile 32 in it lower part for the base 29 assembly. The lateral shelves are joined through screws 33, and the front shelf is joined through a specially designed plastic fastening corner element 34, FIGS. 6 and 11, with overlapping elements 35, to facilitate screwing while it has bolts 36 penetrating into holes 37 placed for better screwing and rough use. The chest of drawers 26 also has sliding elements 38 with their corresponding parts 39 for drawers 26 sliding. The shelf 31 can have extruded profiles on its edges for a better finishing can be lined veneer strip adhered through a glue.

Figure 14:
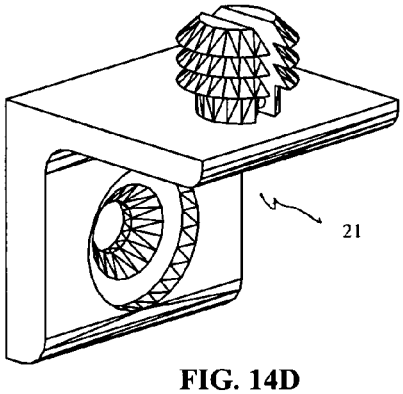
Figure 14D:
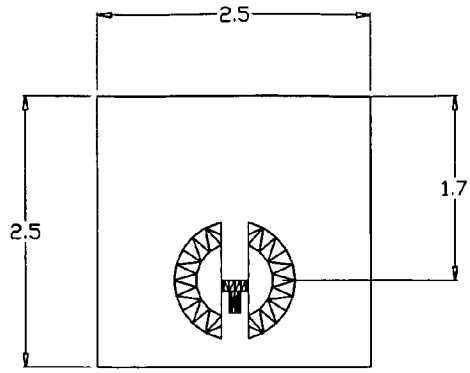
Figure 14D:
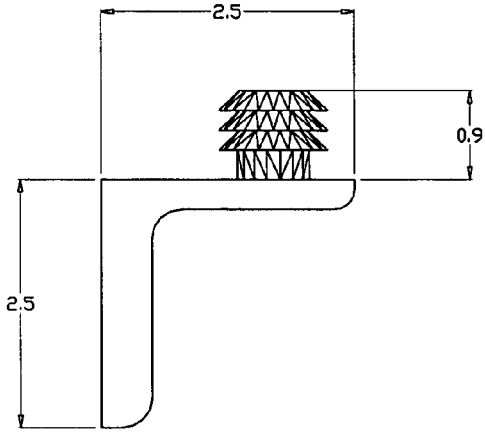
Figure 14D:
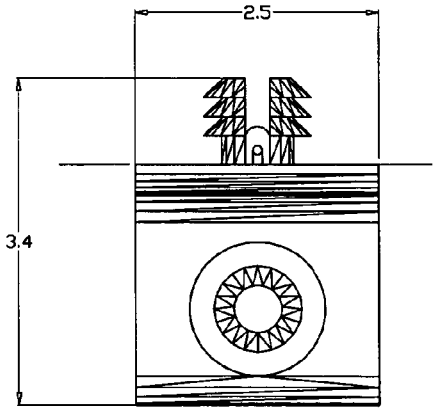

On FIG. 14 D, the fastening element design 21 FIG. 14 can be seen on the walls, said design permits a better pressure fastening onto the shelves because of its cone shape, and can be screwed onto the wall of the enclosure through the use of conventional pegs.

MODULAR SYSTEM CHARACTERISTICS

- The modular system package is the first and most important communication vehicle with the client. It shows a photograph of the assembled and installed product in an adequate enclosure and with several items of a house wardrobe. In these photographs, the high design efficiency is shown taking advantage of the width and height of the available wardrobe space.
- On the package, an exploded drawing is shown that presents the set of pieces to communicate to the client the contents of the package (the drawing omits assembly and installation fittings and only mentions them through letters).
- The package shows the recommended minimum and maximum width ranges, the advantages of the product and the adjustment options with regard to the width of several existing enclosures.
- The architectonic design and the placement of the parts in said package fulfill the applicable standards.
- The placement of the pieces inside the package is such that the contents support the weight of the packages stowed on top preventing damages to the packages.
- The size of the packages permit to stow on standard 40"×48" pallets which are placed according to already established patterns for warehouse storage standard structures, within marine containers, piggy backs, trailers and other long distance means of transportation.

There are hydraulic skates, freight lifts and other implements to move them easily.

It is easier for the user to carry a package in his or her own vehicle.

On the packages leaflets are placed which are easily understandable without the need to read the text. For this reason it is not necessary that the installer knows or understands one of the three languages in which those texts are written.

Packages and the labels are printed in colors that are characteristic for each model and the short and clear keys of the products are shown in a large size on all the faces of the packages; in this way, they can be easily identified even though they are high up on the storage metal structures.

The advantages of the described invention have been presented in an economical and practical manner. Although specific embodiments and example configurations have been described, it is to be understood that various modifications and additional configurations will be apparent to the skilled in the art. It is intended that the specific embodiments and configurations herein are illustrative of the preferred and best modes for practicing the invention, and should not be interpreted as limitations on the scope of the invention as defined by appended claims.

The invention claimed is:

1. A modular system having adjustable units for use inside closets of different widths, the system comprising a tower module based on lateral screens and multiple shelves, wherein one of the lateral screens is taller than the other, said tower module being fastened onto an enclosure space in a fixed position and is combined on its sides with hanging modules, one of the hanging modules accommodating long clothes and having a shelf panel placed in its upper part and having a hanging pipe held by fastening elements on an enclosure wall and on a shorter of the tower lateral screens; the other hanging module is a double hanging module having two hanging sections with two hanging pipes held by fastening elements on an opposing enclosure wall and on a taller of the tower lateral screens.

2. A modular system according to claim 1, wherein each lateral screen has two coupled sections to form a single lateral screen.

3. A modular system according to claim 1, wherein the double hanging module has a shelf panel that is supported on the taller screen of the tower module and on the fastening element of the upper hanging pipe, said shelf panel fastened onto back wall through fastening elements and a supporting element for excess load, the supporting element being a fork type which opposes compression stresses.

4. A modular system according to claim 3, wherein the tower module includes sliding chests of drawers with edges lined and reinforced with extruded PVC edges or with plastic tape.

5. A modular system according to claim 1, wherein the tower module includes sliding chests of drawers with edges lined and reinforced with extruded PVC edges or with plastic tape.

6. A modular system according to claim 5, wherein each of the drawers has members which are assembled through grooved channels, the lateral members joined onto the back member through screws and the front member is joined to the lateral members through plastic fastening corner elements having on one of their faces bolt protuberances adjusted to holes in one of the members and on the other side the corner elements are fastened through screws; said drawer being moved through sliding elements.

7. A modular system according to claim 1, wherein the hanging pipes are made of steel of oval cross section and covered with polyvinyl chloride (PVC).

8. A modular system according to claim 1, wherein the shelves of the main tower module can be fastened to the respective screens and at different spaces, larger or smaller, depending on the need of user.

9. A modular system according to claim 1, wherein the lateral screens are no larger than half the size of the depth of the shelves, thereby facilitating ventilation and elimination of moisture.

10. A modular system according to claim 9, wherein the lateral screens have a depth of 20 cm.

11. A modular system according to claim 1, wherein each of the shelves contains veneer strip with portions on the left and right side edges and can include in their left and right side edges a "U" shaped total or partial reinforcement to increase their mechanical strength, fastened through screws.

12. A modular system according to claim 1, wherein the thickness of the lateral screens is the same as the thickness of the tower shelves.

13. A modular system according to claim 1 wherein the shelves are made of agglomerated material.

14. A modular system according to claim 13 wherein the shelves are 40 cm deep and 61 cm long.

15. A modular system according to claim 1 wherein the lateral screens further comprise reinforcement with extruded plastic profiles or veneer strips.

* * * * *